United States Patent [19]

Warner

[11] Patent Number: 4,838,735

[45] Date of Patent: Jun. 13, 1989

[54] STABLE FLOATING PIER

[76] Inventor: Bert J. Warner, 504 Towncreek, Dallas, Tex. 75232

[21] Appl. No.: 161,781

[22] Filed: Feb. 29, 1988

[51] Int. Cl.[4] ..... B63B 27/14

[52] U.S. Cl. ..... 405/220; 405/218; 405/219; 114/267; 14/3; 14/71.1

[58] Field of Search ..... 405/219, 220, 221; 114/266, 267; 14/3, 4, 13, 14, 69.5, 71.1

[56] References Cited

U.S. PATENT DOCUMENTS

| | | | |
|---|---|---|---|
| 2,715,314 | 8/1955 | Smith . | |
| 2,856,704 | 10/1958 | Hebert | 405/219 X |
| 2,924,191 | 2/1960 | Blumquist et al. . | |
| 3,492,825 | 2/1970 | Pearson . | |
| 3,620,027 | 4/1968 | Nordell | 405/219 |
| 3,722,223 | 3/1973 | Gratz . | |
| 4,311,413 | 1/1982 | Sluys | 405/219 |
| 4,335,981 | 6/1982 | Akiyama et al. . | |
| 4,441,449 | 4/1984 | Biaggi . | |
| 4,581,784 | 4/1986 | Rousseau et al. . | |

*Primary Examiner*—Randolph A. Reese
*Assistant Examiner*—J. Russell McBee
*Attorney, Agent, or Firm*—Drude Faulconer

[57] ABSTRACT

A floating pier structure comprising a floating platform, an anchored base, and an articulated, parallelogram linkage structure pivotably connecting the platform to the base so that the platform will remain substantially level on the surface as water conditions change. The linkage is also pivoted to the base so that the platform can be swung into shore without disassembly.

3 Claims, 3 Drawing Sheets

STABLE FLOATING PIER

DESCRIPTION

1. Technical Field

The present invention relates to a floating pier and more particularly relates to a stable pier structure comprising a floating platform connected to a fixed point shoreline by an articulated, parallelogram linkage providing a walkway from the shore to the platform.

2. Background Art

Piers are commonly installed along a shoreline of a body of water for a variety of purposes. For example, piers are commonly used on inland lakes and rivers for recreational purposes, e.g., fishing, swimming, docking of boats, etc. Where permanent structures are applicable and permitted by law, posts or pilings are routinely set into the bottom of the water body and the pier is built thereon. However, in those areas where weather or legal restrictions prevent the use of such permanent structures, it is not uncommon to anchor a floating platform off the shoreline and secure it to shore by some type of a walkway structure or the like. Although such structures are meant to be temporary, the components used in their construction are usually large, heavy, and bulky which require a considerable effort to install and remove. Since such piers cannot be removed quickly, they are vulnerable to severe weather conditions and are likely to be severely damaged or destroyed by a sudden storm.

Therefore, the need exists for a truly temporary pier structure that can be easily installed at a desired location and then quickly removed or retrieved onto shore if the need arises.

DISCLOSURE OF INVENTION

The present invention provides a floating pier which can be easily installed in a body of water and then quickly removed or recovered to shore if the need arises. More specifically, the present pier structure is comprised of a platform structure adapted to be floated on a body of water; a base structure adapted top fixed at a desired position; and an articulated, parallelogram linkage structure which pivotably connects the platform to the base and which provides support for a walkway to the platform.

The parallelogram linkage structure, itself, is comprised of a top link which provides the primary strength member of the linkage and an independent bottom link which provides the stablizing member. The design places the load of the walkway upon the entire surface of the platform making it less reactive to off-center loading and therefore more stable. The top member is an elongated element, e.g. triangular in cross-section, which is pivotably connected at one end to the platform and at its other end to the base. The two links pivot about horizontal axes and remain parallel to each other as the platform rises or falls due to changing water conditions. Both links are also pivoted about a vertical axis on an anchor component of the base structure which, in turn, is fixed in position. This allows the linkage and the platform to pivot about the base structure so that the linkage and the attached platform can be pulled into shore without disassembly.

Vertical link means pivotably connect the top and bottom links together at spaced intervals to thereby form a flexible parallelogram linkage. The vertical links are formed of pairs of risers spaced along the linkage. A riser of each pair is positioned on either side of the linkage and each is connected at a first point near the lower end thereof to the bottom link and at a second point to the top link. Each riser extends substantially vertically upward from the second point. A handrail extends along and is secured to the upper ends of the risers on each side of the linkage. A walkway extends along the linkage and between each pair of risers and is supported thereby to provide access to the platform.

A typical recreational pier in accordance with the present invention can be quickly installed by a few workmen with no special tools or expensive equipment. Larger piers can also be installed with considerably less time and effort than is normally required with prior known equivalent pier structures.

BRIEF DESCRIPTION OF THE DRAWINGS

The actual construction, operation, and apparent advantages of the present invention will be better understood by referring to the drawings in which like numerals identify like parts and in which.

BEST MODE FOR CARRYING OUT THE INVENTION

Figure 2:
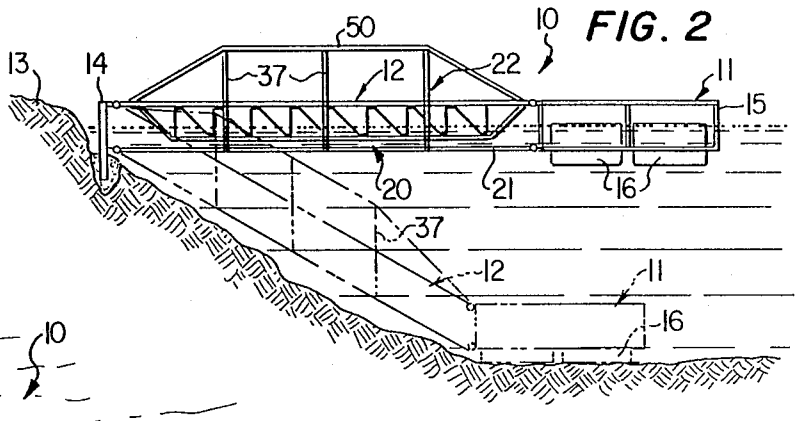
FIG. 2 is a side view of the pier of FIG. 1.
Figure 1:
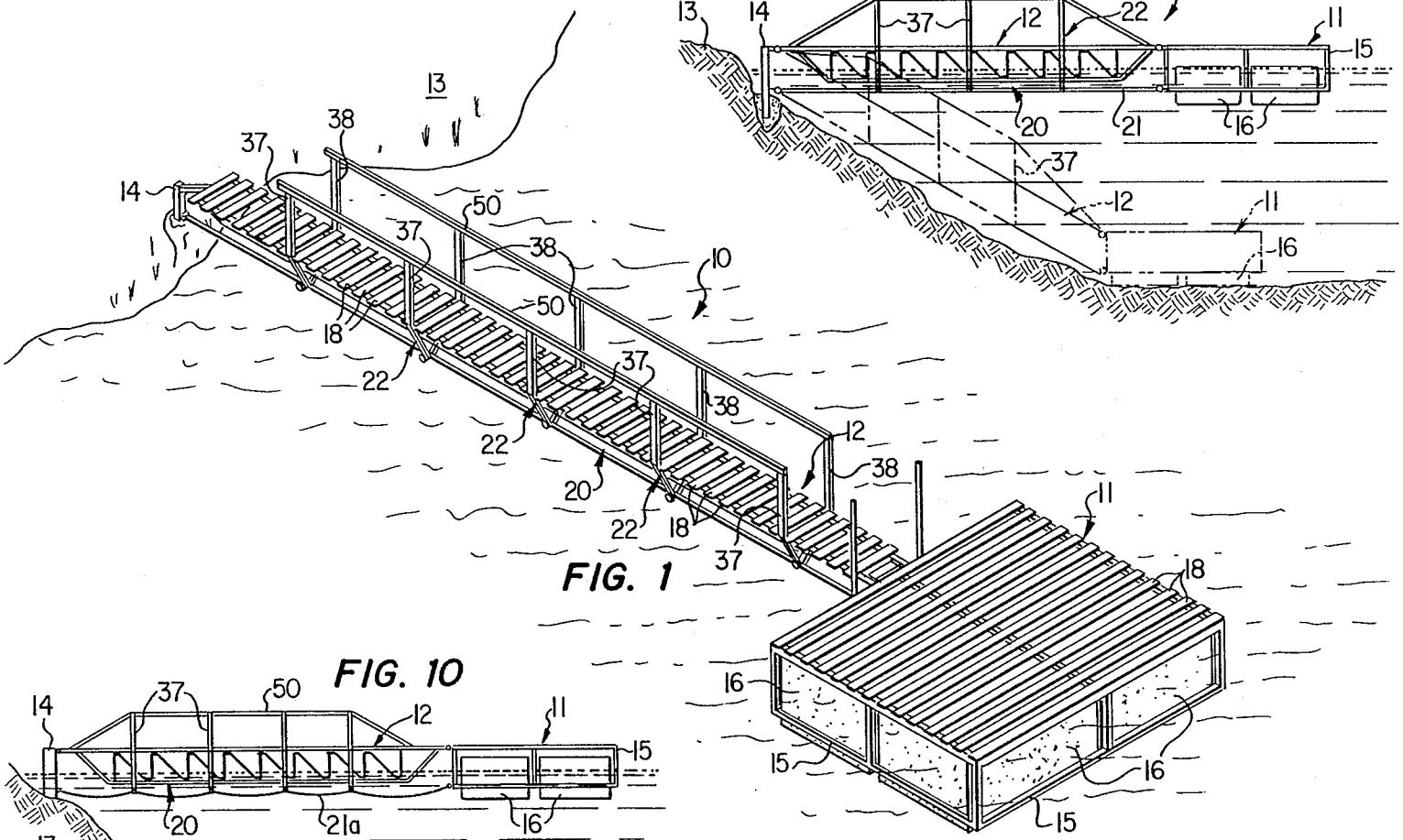
FIG. 1 is a perspective of the floating pier structure of the present invention.

Referring more particularly to the drawings, FIGS. 1–5 disclose a floating pier structure 10 in accordance with the present invention. Pier 10 is comprised of floating platform 11 and an articulated, parallelogram linkage 12 which connects platform 11 with shoreline 13. As shown, platform 11 is constructed of frame 15 which has one or more floatation means 16 (FIGS. 1, 2, 6) mounted therein. Means 16 may be of any type means commonly used for floatation purposes, e.g., blocks of foamed material, sealed air tanks, tanks that can be flooded and emptied of water, tanks or enclosures filled with foamed material, etc. While platform 11 has been illustrated as being rectangular in configuration and as having a decking constructed of boards 18 (FIG. 1), it should be understood that the configuration and/or deck covering of the platform can vary widely without departing from the present invention.

Articulated linkage 12 provides the means for stablizing platform 11, and securing it to shoreline 13 and for providing access to the platform from shoreline 13. Articulated linkage 12 is comprised of a top link 20 and a bottom or stablizing link 21 which are pivotably connected together by connecting vertical links 22 to form a parallelogram linkage which remains relatively stable as platform 11 rises or falls due to water conditions. This permits platform 11 to maintain a level position on the surface of the water even in rough water, uneven loading of platform 11, or changing tides.

Figure 4:
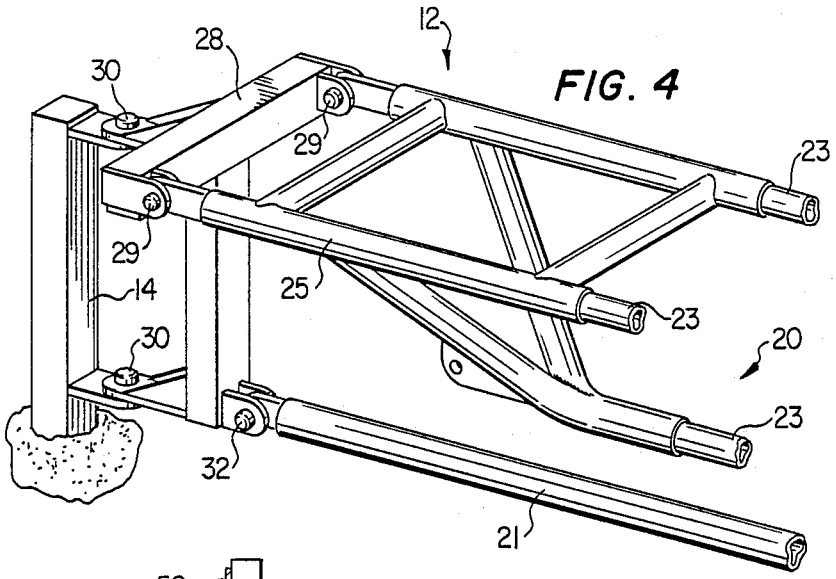
FIG. 4 is a perspective of one end of the linkage of FIG. 3 shown connected to a base structure.
Figure 3:
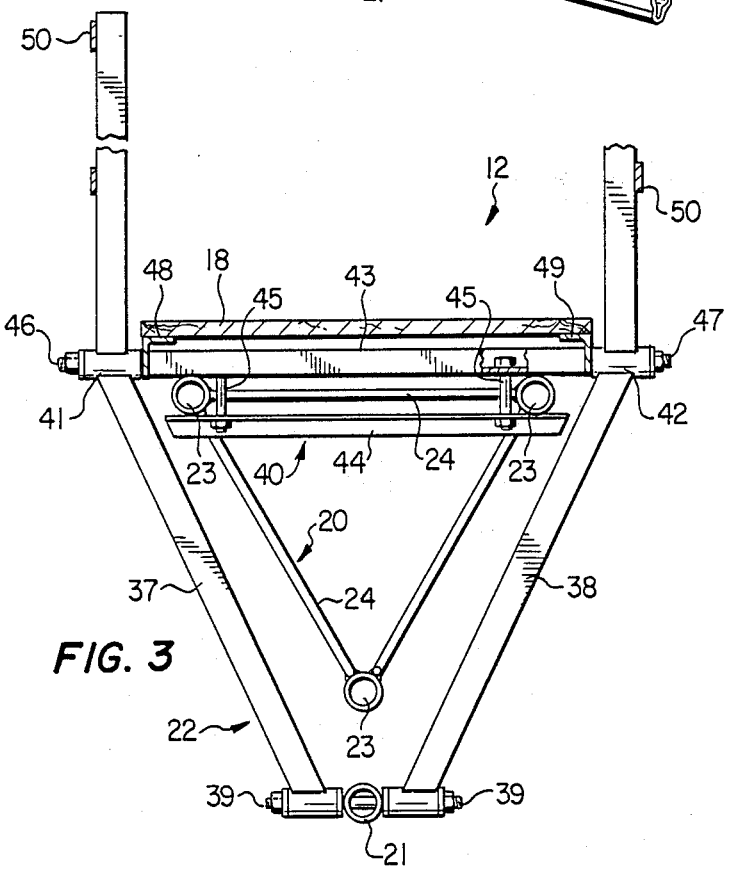
FIG. 3 is a cross-sectional view, partly broken away, of the linkage structure of the pier of FIG. 1.
Figure 5:
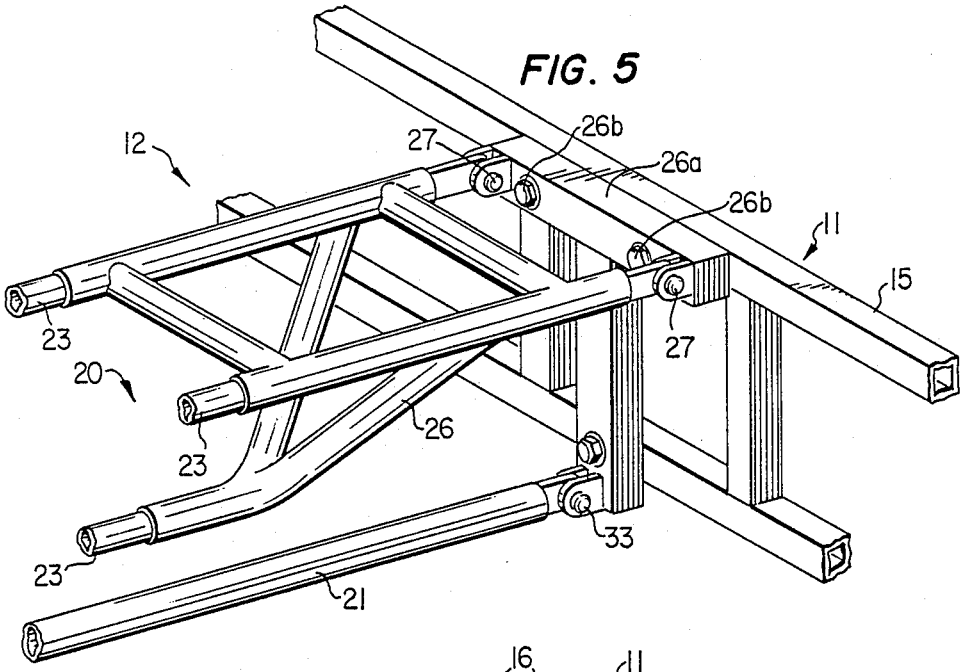
FIG. 5 is a perspective view of the other end of the linkage structure of FIG. 3 shown connected to a platform.
Figure 6:
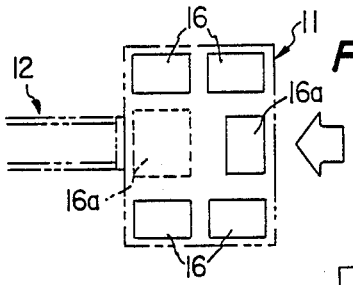
FIG. 6 is a top view of the platform of the present pier structure.

As shown, top link 20 which is the primary strength component of pier 10 is shown as being triangular in cross-section and is formed of three lengths of pipe 23 joined together by appropriate bracing 24 (FIG. 3). Commercially-available supports sections used for constructing small communication antenna towers are particularly suitable for use as to link 20. The ends of the three pipes 23 are all fixed into terminals 25, 26, respectively (FIGS. 4,5). Terminal 26 (FIG. 5) is pivotally connected to T-shaped support **26*a* by pins or bolts 27 to permit relative rotation therebetween about a horizontal axis. The T-shaped support 26*a* is bolted to platform 11 by bolts 26*b*. Terminal 25 (FIG. 4) is pivotably connected to T-shaped support 28 by pins or bolts 29** to also allow relative rotation therebetween about a horizontal axis.

Support 28, in turn, is pivotably connected on anchor post or base 14 by pins or bolts 30 to allow relative rotation therebetween about a vertical axis. Base 14 may be a post cemented in place on shore 13 or may be a post embedded in the water bottom near the shore (FIG. 2). Further, base 14 may be a part of an already existing structure in or near the water's edge, e.g., a leg of an existing pier, a part of a building or wall, etc. Still further, base 14 may be portable, e.g., a post cast in a concrete block of sufficient size to resist the forces applied thereto by the platform and linkage.

Figure 10:
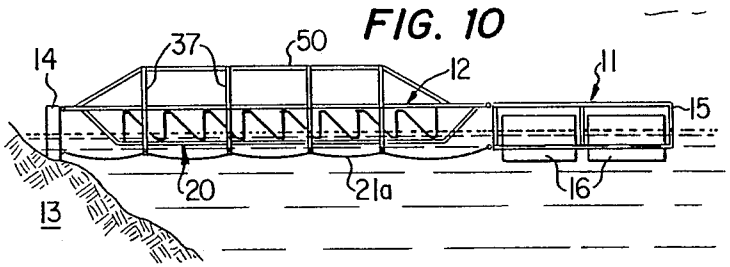
FIG. 10 is a side view of still another embodiment of the present pier.

The bottom link 21 of the parallelogram is preferably a rigid length of pipe or the like which is pivoted at its ends for relative horizontal rotation to support 28 (FIG. 4) and T-shaped support **26*a* (FIG. 5) by pins or bolts 32, 33, respectively. By placing flotation means 16 along the sides and the front of platform 11 (FIG. 6), the buoyant forces on the platform will be such that lower link 21 will always be loaded under tension. If flotation means 16 are to be so positioned, a flexible lower link (length of cable or chain 21*a* in FIG. 10) can be used in place of rigid pipe link 21 since the tension forces will keep either a rigid or a flexible link under load. If the flotation means 16*a* is moved from the front to the back of platform (dotted lines in FIG. 6), lower link 21 will be loaded in compression so only a rigid link can be used as stablizing link 21**.

Top link 20 and bottom or stablizing link 21 can pivot independently of each other with respect to both platform 11 and base 14 but are pivotably coupled together by connecting link 22 to form an integral parallelogram linkage, the advantages of which will become apparent in the following discussions. Each connecting link 22 is comprised of a pair of risers 37, 38, spaced at intervals along linkage 12. One riser of each pair is positioned on either side of linkage 12. As best seen in FIG. 3, the lower end of each riser 37, 38 is pivotably secured on lower link 21 by pins or bolts 39 so as to permit relative rotation therebetween about a horizontal axis. Risers 37, 38 taper outward and upward from link 21 to a point 41, 42, respectively, just about top link 20 and then extend substantially vertically upward through the remainder of their lengths.

Each pair of risers 37, 38 is coupled to top link 20 at each spaced interval by bracket means 40 which, in turn, is comprised of an upper cross member 43 which spans between risers 37, 38 at points 41, 42 above upper pipes 23 of top link 20 and a shorter cross member 44 which is positioned below said pipes 23. Members 43, 44 are connected together by bolts 45, to thereby clamp bracket 40 onto pipes 33. Upper cross member 43 is pivotally connected at each end thereof to risers 37, 38 at points 41, 42, respectively, by pins or bolts 46, 47, respectively, to permit relative horizontal rotation between cross member 43 and risers 37, 38.

Channel members 48, 49 (FIG. 3) lie adjacent points 41, 42, respectively, on risers 37, 38 and extend throughout the length of linkage 12. Each channel member is mounted to brackets 40 and risers 37, 38 by pins or bolts 46, 47 which pass through holes in said channel members and which permit limited rotation therebetween. Boards 18 or the like are spaced across and secured to channel members 48, 49 to form a walkway on linkage 12 which provides access to platform 11 from shore 13. Handrails 50 are secured along the tops of risers 37, 38, for safety purposes as will be fully understood.

It can be seen that top link 20 and bottom link 21 can pivot about horizontal axes independently of each other whenever platform 11 rises or falls in the body of water while risers 37, 38, due to their pivotable connections to both upper link 20 and lower link 21 remain substantially vertical. Since linkage 12 functions as a parallelogram, platform 11 is forced to maintain a level position on the water's surface as it bobs or moves up and down with changing water conditions and does not experience any subtantial torsional forces which would otherwise occur if a single fixed link was pivoted between the shore and platform 11.

It should be understood that a floating pier in accordance with the present invention may be of any practical size and platform 11 may take a variety of shapes. Also, while upper link 20 has been illustrated as having a substantially equilateral triangular cross-section, it could have other cross-sectional configuration, e.g., isosceles triangular cross-sections, T-shaped configurations, etc., as long as it was designed to provide the strength needed in a particular application.

Pier 10 of the present invention can be assembled and installed quickly and economically in almost any environment. For example, to install the present pier at a lakeshore location for use in common recreational activities, e.g., boating, swimming, fishing, etc., platform 11, if small enough, would preferably be preassembled with flotation means 16 in place and would be transported to location on a truck or trailer. If the platform is too large to be transported in this fashion, the parts could be transported and easily assembled on site. Platform 11 is pushed into the body of water and top and bottom links 20, 21 of linkage 12 are connected to frame 15 of platform 11 (FIG. 5) with bolts 27, 33 and is pushed further out into the water by linkage 12, itself. The terminal 25 and link 21 is then connected by bolts 29, 32 (FIG. 4) to T-shaped support 28 which has been already connected to preset base 14. With typical sized piers (e.g., platform dimensions of by 12' by 1.75'; 10.5' lengths of linkage 12), two men can install a pier within 3 hours without the need for any expensive equipment. Of course, it should be recognized that more than one section of linkage 12 can be used if a need or desire exists to float platform 11 at a distance from shore greater than possible with one section. It will be apparent that this can easily be accomplished by simply connecting additional lengths of section 20 to the walkway until the desired length is attained. The same is true with sections of lower or stabilizing link 21 which may be connected together at their ends. To disassemble, the above procedure is merely reversed.

This relatively easy assembly and disassembly permits pier 10 to be removed from the water and stored during extended periods of nonuse or adverse weather conditions, e.g., areas of severe freezing in winter months, etc., thereby preventing possible severe damage or destruction of the pier.

Figure 7:
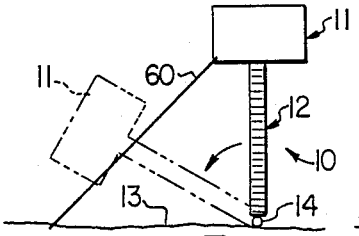
FIG. 7 is a top view, schematical illustration of the present pier in position off a shoreline.

Further, since the pier is pivotably mounted to base 14, platform 11 can be quickly swung into shore 13 (FIG. 7) in the event of inclement weather or other reason by attaching a line 60 to platform 11 and pulling it into shore for temporary storage without the need to disassemble the per. Pier 10 can then be quickly repositioned when desired by merely pushing platform 11 away from shore 13 back to its desired position. Maintenance, e.g., painting, and/or modification of platform 11 and/or linkage 12 can be easily carried out while pier 10 is on shore. In the modification shown in FIG. 2, flotation means 16 are formed of tanks, which can be flooded or emptied of water so that pier 10 can be quickly sunk (dotted lines in FIG. 2) if threatening weather conditions arise before the pier can be brought into shore. An air hose (not shown) can be left connected to each of the tanks 16 or can be connected by a swimmer to force the water out of the tanks to raise the pier when desired. By sinking the pier, it is protected from any severe wind and wave damage.

Figure 8:
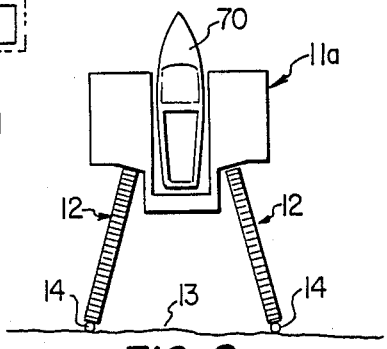
FIG. 8 is top view of another embodiment of the present pier.

In FIG. 8, two articulated, parallelograms linkages 12 are shown to fix floating platform 11*a* in a stable position off shore 13. Each linkage 12 is constructed as described above and each provides a walkway to the platform. Each parallelogram linkage functions as before, i.e., to maintain floating platform 11*a* in a level condition regardless of changes in the depth of the water. As illustrated, platform 11*a* is constructed with a boat slip therein for docking a boat 70.

Figure 9:
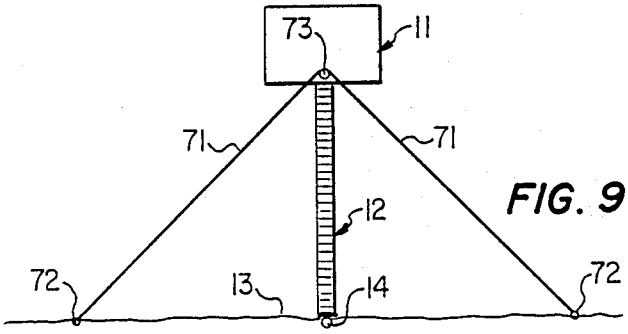
FIG. 9 is a top view of further embodiment of the present pier.

FIG. 9 illustrates a further modification of the present invention where a continuous anchor rope 71 is fixed at either end to shore 13 at spaced points 72. Rope 71 is wound on reversible motor windlass 73 which is operable in response to tension on rope 71 on either side of windlass 73. Waves impinging against platform 11 will try to rotate pier 10 about base 14 in the direction of the waves. This increases tension in rope 71 on the side of the oncoming waves which, in turn, cause windlass 73 to wind rope 71 in a direction to oppose this tension until the tension in rope 71 on both sides of windlass 73 is equal, at which time windlass 73 stops. Platform 11 should then be headed directly into the waves (broad arrow in FIG. 6) thereby adding to the stability of platform 11.

Figure 11:
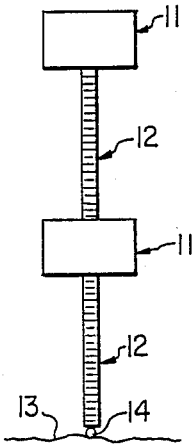
FIG. 11 is a top view of further embodiment of the present pier.

FIG. 11 illustrates how multiples of 12 and 11 can be used to extend the length of the pier to longer distances from shore. This would be accomplished of platform 11 and then connecting a terminal 25 so that an additional linkage 12 could be formed which would then be connected to an additional platform 11. In this way there would be practically no limit to the length of the platform out from shore.

What is claimed:

1. A floating pier comprising:

a platform structure adapted to be floated on a body of water;

a base structure adapted to be anchored in a fixed position; said base structure comprising:

an anchored structure adapted to be fixed in position;

a support structure pivotably connected to said anchored structure for relative rotation therebetween about a vertical axis;

an articulated parallelogram linkage structure for connecting said platform structure to said base structure, said linkage structure comprising:

a top link comprised of an elongated element having a triangular cross-section having an upper side lying in a horizontal plane;

means for pivotably connecting a first end of said top link to said platform structure for relative rotation therebetween about a horizontal axis;

means for pivotably connecting the other end of said top link to said support structure for relative rotation therebetween about a horizontal axis;

a bottom link positioned parallel to and spaced below said top link;

means for pivotably connecting a first end of said bottom link to said platform structure for relative rotation therebetween about a horizontal axis;

means for pivotably connecting the other end of said bottom link to said support structure for relative rotation therebetween about a horizontal axis;

vertical link means for pivotably connecting said top link and said bottom link together at spaced intervals to thereby form a parallelogram linkage structure; and a walkway secured to and extending along said top link of said articulated parallelogram linkage structure.

2. The floating pier of claim 1 wherein said vertical link means comprises:

a plurality of risers spaced at intervals along said articulated, parallelogram linkage; said risers being positioned in paris with one riser of each pair positioned on either side of said linkage;

means for pivotably connecting each of said risers at one point thereon to said bottom link to allow relative rotation therebetween about a horizontal axis;

means for pivotably connecting each of said risers at a second point thereon to said top link to allow relative rotation therebetween about a horizontal axis to thereby form said parallelogram linkage.

3. The floating pier of claim 2 wherein each of risers extend vertically upward from said second point; and a handrail extending along either side of said linkage attached to the tops of said risers on a respective side of said linkage.

* * * * *